US009121339B2

(12) United States Patent
Kimura et al.

(10) Patent No.: US 9,121,339 B2
(45) Date of Patent: Sep. 1, 2015

(54) BRUSHCUTTER

(75) Inventors: Takayuki Kimura, Kawaguchi (JP); Hiroshi Hokari, Kawagoe (JP); Yuusuke Kawasaki, Tokorozawa (JP)

(73) Assignee: HUSQVARNA AB, Huskvarna (SE)

( * ) Notice: Subject to any disclaimer, the term of this patent is extended or adjusted under 35 U.S.C. 154(b) by 3 days.

(21) Appl. No.: 13/978,799

(22) PCT Filed: Jul. 21, 2011

(86) PCT No.: PCT/JP2011/004115

§ 371 (c)(1), (2), (4) Date: Jul. 9, 2013

(87) PCT Pub. No.: WO2012/117457

PCT Pub. Date: Sep. 7, 2012

(65) Prior Publication Data

US 2013/0284126 A1 Oct. 31, 2013

(30) Foreign Application Priority Data

Feb. 28, 2011 (JP) ..... 2011-042213

(51) Int. Cl.

| | |
|---|---|
| ***F01P 7/04*** | (2006.01) |
| ***B26B 7/00*** | (2006.01) |
| ***F02B 63/02*** | (2006.01) |
| ***F01P 1/06*** | (2006.01) |
| ***F01P 5/06*** | (2006.01) |

(52) U.S. Cl.

CPC . *F02B 63/02* (2013.01); *F01P 1/06* (2013.01); *F01P 5/06* (2013.01)

(58) Field of Classification Search

CPC ..... B25B 21/00; B25B 23/147; B25F 5/001; F02B 63/02; B26B 3/00; B26B 7/00

USPC ..... 123/41.01, 41.56, 41.63, 41.65; 30/165, 30/272.1, 276

See application file for complete search history.

(56) References Cited

U.S. PATENT DOCUMENTS 4,841,929 A * 6/1989 Tuggle et al. ..... 123/198 E
6,523,508 B2 * 2/2003 Husges et al. ..... 123/41.65

(Continued)

OTHER PUBLICATIONS

International Search Report and Written Opinion of PCT/JP2011/004115 mailed Nov. 23, 2011.

(Continued)

*Primary Examiner* — Marguerite McMahon
*Assistant Examiner* — Tea Holbrook
(74) *Attorney, Agent, or Firm* — Nelson Mullins Riley & Scarborough LLP

(57) ABSTRACT

A brushcutter includes: a centrifugal clutch (20) that transmits a drive force of an engine from a crankshaft to a drive shaft; a clutch housing (23) covering the cooling fan and the centrifugal clutch, the clutch housing being made of a synthetic resin; and a bearing that is held inside the clutch housing (23) and supports a coupling shaft that couples the drive shaft and the centrifugal clutch (20). A volute-shaped air-flow space (27) defined including a rise wall (26) surrounding the centrifugal clutch (20) is provided inside the clutch housing (23) near an outer circumference of the centrifugal clutch (20). An inflow opening (28, 29) that lets a cooling air flowing in the air-flow space (27) flow into an inner air-flow space (53) and an outflow opening (52) that lets the cooling air flowing in the air-flow space (53) flow out to the air-flow space (27) are provided on the rise wall (26).

3 Claims, 4 Drawing Sheets

(56) References Cited

U.S. PATENT DOCUMENTS

| | | | | |
|---|---|---|---|---|
| 6,550,145 | B2 * | 4/2003 | Stoll et al. | 30/276 |
| 6,640,443 | B2 * | 11/2003 | Husges et al. | 30/276 |
| 6,754,962 | B2 * | 6/2004 | Warashina et al. | 30/276 |
| 8,783,433 | B2 * | 7/2014 | Brevick | 192/70.12 |
| 2001/0037776 | A1 | 11/2001 | Husges et al. | |
| 2001/0039736 | A1 * | 11/2001 | Husges et al. | 30/276 |
| 2005/0274021 | A1 * | 12/2005 | Warashina et al. | 30/76 |
| 2009/0113724 | A1 * | 5/2009 | Wied et al. | 30/276 |

OTHER PUBLICATIONS

Chapter I International Preliminary Report on Patentability of PCT/JP2011/004115 mailed Sep. 3, 2013.

* cited by examiner

BRUSHCUTTER

TECHNICAL FIELD

The present invention relates to a brushcutter and particularly to an improvement in a cooling mechanism of a centrifugal clutch.

BACKGROUND ART

Known brushcutters often employ an engine as a drive source. In the brushcutters, a drive force from the drive source is transmitted to a shaft in an operating rod via a centrifugal clutch. The drive force rotates an attachment such as a chip saw and a nylon cutter that is attached to an end of the shaft.

The centrifugal clutch includes: an attachment plate coupled to a crankshaft of the engine; a clutch shoe rotatably attached to the attachment plate, the clutch shoe rotating in accordance with centrifugal force; and a clutch drum frictionally engaged with the clutch shoe that is rotated radially outward, the clutch drum being connected with a base end of the shaft. The drive force is transmitted via the clutch shoe and the clutch drum that are mutually frictionally engaged.

The centrifugal clutch is disposed at an outer side of a cooling fan rotatably attached to the crankshaft and is entirely covered with a clutch housing. A bearing for supporting the shaft connected to the clutch drum is held within the clutch housing.

The clutch housing is made of metal or, alternatively, made of a synthetic resin in order to reduce the weight thereof. Clutch housings made of a synthetic resin are easily affected by a friction heat generated by the friction between the clutch shoe and the clutch drum.

Accordingly, when, for instance, lengthening a nylon head of a nylon cutter in order to mow a large amount of grasses within a short time, the load on the shaft is increased to cause continuous slip between the clutch drum and the clutch shoe, so that the temperature of the centrifugal clutch becomes high. Consequently, on account of radiation heat from the centrifugal clutch, the clutch housing may be heated beyond a softening temperature thereof to be deformed to cause dropoff of the bearing.

Accordingly, a large number of external-air inlet slits are provided on a typical clutch housing at a part corresponding to an outer circumference of the centrifugal clutch. In other words, the cooling air sucked by the cooling fan is inhaled through the slits so that the centrifugal clutch is cooled by the cooling air, thereby keeping the temperature of the centrifugal clutch from becoming excessively high (see, for instance, Patent Literature 1).

CITATION LIST

Patent Literature

[PTL 1] JP 2001-A-355446

SUMMARY OF INVENTION

Technical Problem

However, in the Patent Literature 1, since a plurality of vanes of the cooling fan are provided on both top and bottom sides of the disc-shaped rotor so as to efficiently suck the cooling air through the slits provided to the clutch housing, the structure of the cooling fan becomes complicated.

Further, since the large number of slits are provided to the clutch housing in order to increase the amount of the sucked cooling air, the rigidity of the clutch housing is reduced.

An object of the invention is to provide a brushcutter that is adapted to exhibit a sufficient rigidity of the clutch housing and efficiently cool the centrifugal clutch without complicating the structure of the cooling fan.

BRIEF SUMMARY

A brushcutter according to a first aspect of the invention includes: an engine; a cooling fan attached to a crankshaft of the engine; a drive shaft that has a distal end attached with an attachment; a centrifugal clutch that transmits a drive force of the engine from the crankshaft to a base end of the drive shaft; a clutch housing that covers the cooling fan and the centrifugal clutch, the clutch housing being made of a synthetic resin; and a bearing that is held inside the clutch housing, the bearing supporting a coupling shaft that couples the drive shaft and the centrifugal clutch, in which: a volute-shaped air-flow space defined including a rise wall surrounding the centrifugal clutch is provided inside the clutch housing near an outer circumference of the centrifugal clutch; and an inflow opening that lets a cooling air flowing in the volute-shaped air-flow space flow into an inner air-flow space surrounded by the rise wall and an outflow opening that lets the cooling air flowing in the inner air-flow space flow out toward the volute-shaped air-flow space are provided on the rise wall.

In a brushcutter according to a second aspect of the invention, a guide that partitions the volute-shaped air-flow space to guide the cooling air into the inflow opening is provided immediately at a downstream side of the inflow opening.

The term "downstream side" herein refers to a downstream side in a flow direction of the cooling air.

In a brushcutter according to a third aspect of the invention, the guide is provided by a rib extending between an inner surface of the clutch housing and the rise wall.

In a brushcutter according to a fourth aspect of the invention, the guide is provided by a part of a muffler plate disposed between an exhaust muffler attached to the engine and a cylinder of the engine.

In a brushcutter according to a fifth aspect of the invention, the outflow opening is provided at an upstream side of the inflow opening.

The term "upstream side" herein refers to an upstream side in the flow direction of the cooling air.

According to the first aspect of the invention, the cooling air sucked by the cooling fan flows in the volute-shaped air-flow space provided in the clutch housing. At this time, since the inflow opening and the outflow opening are provided on the rise wall that defines the air-flow space, the cooling air flows from the inflow opening and flows through the air-flow space defined inside the rise wall, so that the centrifugal clutch housed in the air-flow space can be cooled. Then, the cooling air after being cooled flows out of the outflow opening to return to the volute-shaped air-flow space.

Accordingly, the centrifugal clutch can be efficiently cooled by the cooling air sucked by the cooling fan. In addition, since it is not necessary to provide a large number of slits to the clutch housing, a sufficient rigidity of the clutch housing can be secured. Further, since it is not necessary to suck the cooling air from a large number of slits in the clutch housing, complicated structure of the cooling fan is not necessary.

According to the second aspect of the invention, since the guide is provided immediately at a downstream side of the inflow opening, the cooling air that is in contact with the guide can be smoothly guided to the inflow opening, so that the cooling air can be efficiently sent to the centrifugal clutch.

According to the third aspect of the invention, since the reinforcing rib serves also as the guide, the guide is not provided in a shape dedicated for guiding the cooling air. Thus, the formation of the guide does not complicate the structure of the clutch housing and the clutch housing can be easily provided by resin molding.

According to the fourth aspect of the invention, since a part of the muffler plate serves as the guide, it is not necessary to provide a guide that is dedicated for guiding the cooling air, so that the cooling air can be efficiently flowed in while the structure is kept from becoming complicated.

According to the fifth aspect of the invention, since the outflow opening is provided at an upstream side of the inflow opening, the cooling air flowed through the inflow opening can be directed toward the outflow opening while circulating in the outer circumference of the centrifugal clutch. Accordingly, the centrifugal clutch can be effectively exposed in the flow of the cooling air, so that the centrifugal clutch can be efficiently cooled.

DETAILED DESCRIPTION

Figure 1:
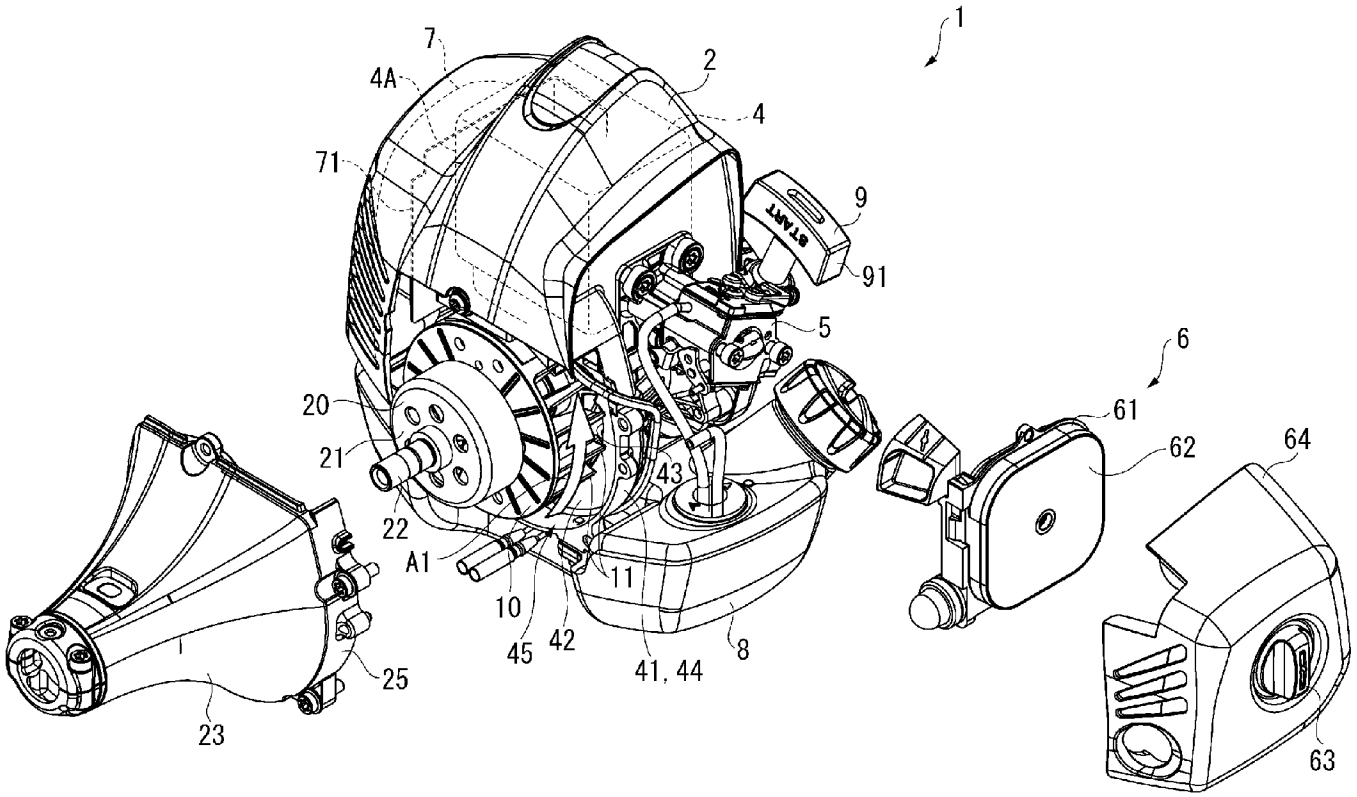
FIG. 1 is an exploded perspective illustrating a body of a brushcutter according to a first exemplary embodiment of the invention.
Figure 2:
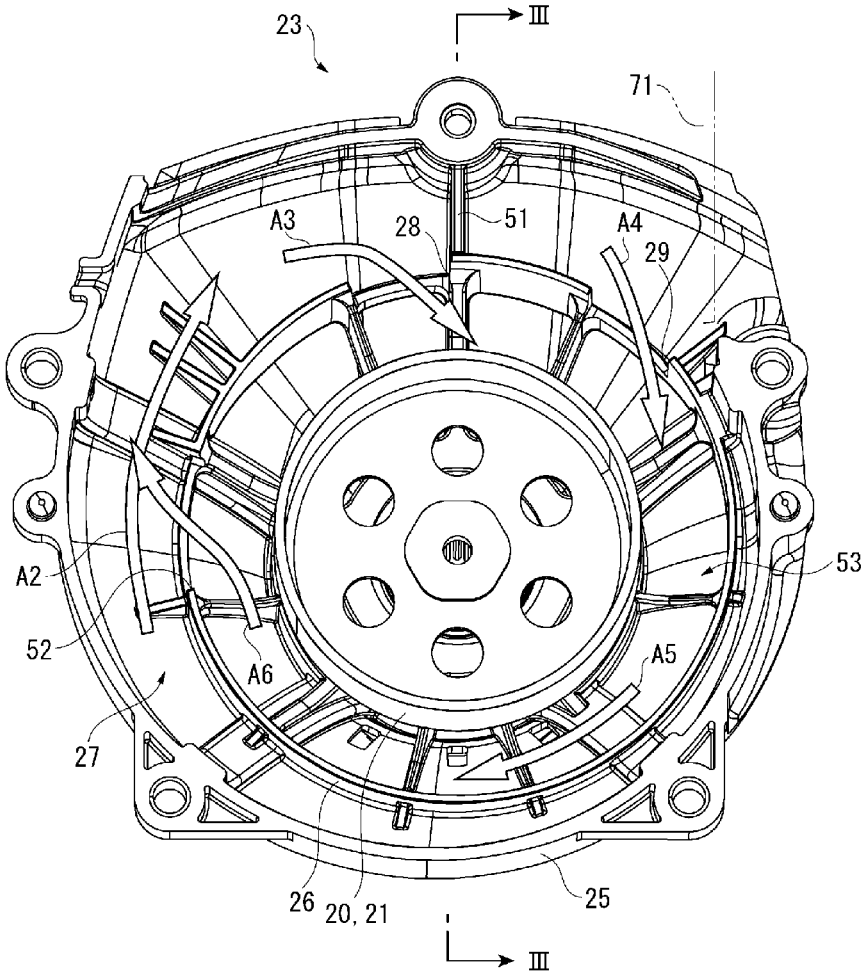
FIG. 2 illustrates an inner structure of a clutch housing of the brushcutter.
Figure 3:
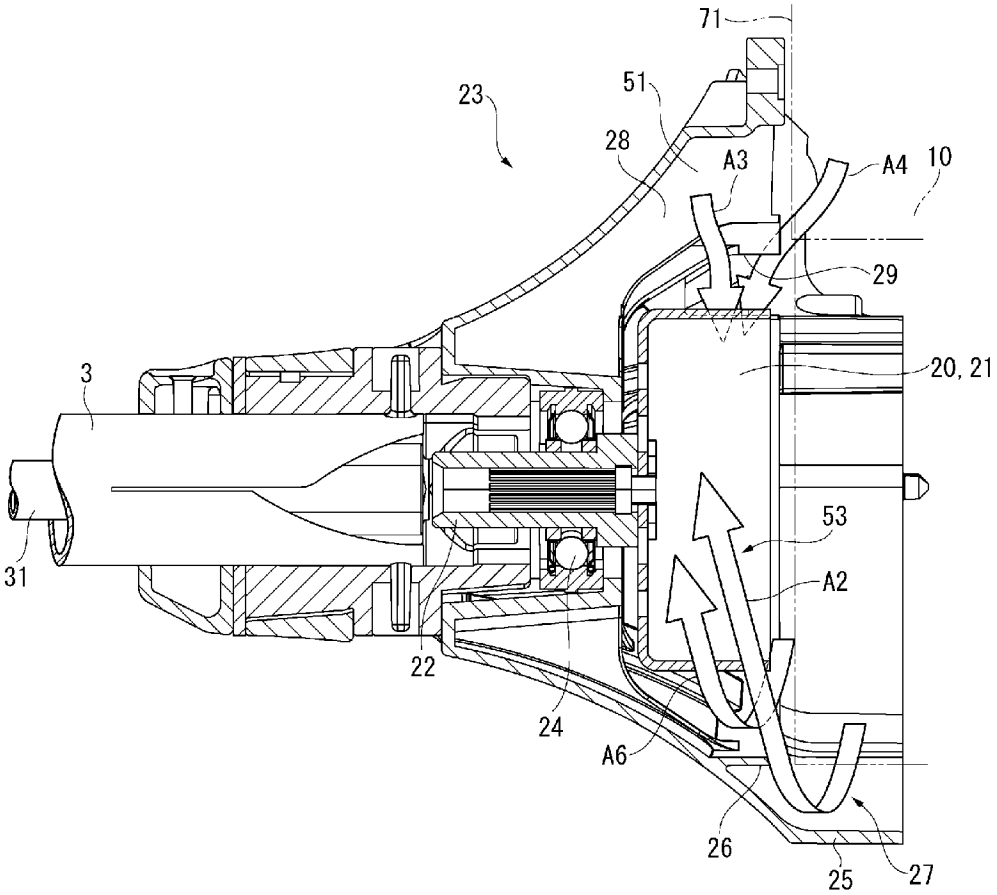
FIG. 3 is a vertical cross section taken along III-III line in FIG. 2.

As shown in FIGS. 1 to 3, a brushcutter 1 includes: a main body 2 that includes a single-cylinder two-stroke engine 4 as a main component; an operating rod 3 having a base end connected to the body 2; an attachment (e.g. chip saw and nylon cutter) attached to another end of the operating rod 3; and a handle attached to a part of the operative rod 3. The engine 4 may be a four-stroke engine.

In the body 2, a carburetor 5 is attached to the engine 4 and an air cleaner 6 is attached to the carburetor 5. An exhaust muffler 7 is attached to the engine 4 at a side opposite to the carburetor 5. A fuel tank 8 is attached to a lower side of the engine 4. Fuel inside the fuel tank 8 is sucked by the carburetor 5.

The air cleaner 6 includes: a cleaner case 61 screwed to the carburetor 5; a spongelike element 62 housed in the cleaner case 61; and a cleaner cover 64 attached to the cleaner case 61 by an operating screw 63.

A recoil starter 9 having an operating knob 91 with a drawstring is attached to an end of a crankshaft (not shown) of the engine 4. A cooling fan 10 having a plurality of vanes 11 and an assembly including a clutch shoe of a centrifugal clutch 20 are attached to the other end of the crankshaft.

The centrifugal clutch 20 is attached to an outside of the cooling fan 10. In addition to the assembly including the clutch shoe, the centrifugal clutch 20 is provided with a clutch drum 21 that is to be frictionally engaged with the clutch shoe when the clutch shoe is rotated radially outward by the centrifugal force. A coupling shaft 22 is attached to the clutch drum 21. A drive shaft 31 rotatably housed within the operating rod 3 is splined to the coupling shaft 22.

The cooling fan 10 and the centrifugal clutch 20 are covered with a clutch housing 23 made of a synthetic resin. The clutch housing 23 is screwed to a fan housing 41 that is united with a crankcase of the engine 4. The clutch housing 23 is widened toward the body 2 to exhibit a horn shape. A bearing 24 that supports the coupling shaft 22 of the clutch drum 21 is held in the clutch housing 23 by insert molding or the like.

In the above brushcutter 1, the power of the engine 4 is transmitted from the crankshaft to the drive shaft 31 via the centrifugal clutch 20 and is transmitted to the attachment from the drive shaft 31 via an appropriate gear device provided at an end of the drive shaft 31. In this arrangement, an opening 43 is provided on an opposed face 42 of the fan housing 41. Cooling air is sucked by the cooling fan 10 rotated together with the crankshaft from the opening 43 through a space between the engine 4 and the fuel tank 8 and is sent toward a cylinder 4A of the engine 4.

A cooling mechanism of the centrifugal clutch 20 will be described below as well as a cooling mechanism of the engine 4.

The fan housing 41 provided with the opening 43 for sucking the cooling air is also provided with a first rise wall 44 that rises along an outer circumference of the fan housing 41. The first rise wall 44 rises in the same direction as the axial direction of the cooling fan 10 and is projected toward the cooling fan 10 relative to the opposed face 42. The first rise wall 44 is continuously extends on the outer circumference of the fan housing 41 from a side near the exhaust muffler 7 through a lower side of the cooling fan 10 toward the carburetor 5. The first rise wall 44 extends away from the outer circumference of the cooling fan 10 toward the carburetor 5.

The above configuration of the first rise wall 44 defines a volute (spiral) shaped first air-flow space 45 between the fan housing 41 and the cooling fan 10. The cooling air sucked from the opening 43 flows in the first air-flow space 45 from below to the above as shown in an arrow A1 in FIG. 1 in accordance with a rotary direction of the cooling fan 10 to be guided toward the cylinder 4A at an upper position.

An L-shaped (in plan view) muffler plate 71 for keeping the radiation heat from the exhaust muffler 7 from being transmitted to the cylinder 4A is provided between the cylinder 4A and the exhaust muffler 7. A part of the lower side of the muffler plate 71 partitions the first air-flow space 45 so that the cooling air is restrained from escaping through a part near the exhaust muffler 7 but is collided with the muffler plate 71 to go around the cylinder 4A.

On the other hand, a second rise wall 25 that rises toward the cooling fan 10 is provided on an outer circumference of the clutch housing 23. When the clutch housing 23 is fixed to the fan housing 41, opposed ends of the first rise wall 44 and the second rise wall 25 are abutted. Further, in this exemplary embodiment, a cylindrical third rise wall 26 that rises toward the cooling fan 10 is likewise provided inside the clutch housing 23. The third rise wall 26 surrounds the centrifugal clutch 20 and has approximately the same outer diameter as that of the cooling fan 10.

Accordingly, a volute shaped second air-flow space 27 that is approximately similar to the first air-flow space 45 is defined inside the clutch housing 23 by the space between the second rise wall 25 and the third rise wall 26. The first air-flow space 45 and the second air-flow space 27 are mutually communicated. The cooling air sucked by the cooling fan 10 flows likewise in the second air-flow space 27 as shown in an arrow A2 in FIGS. 2 and 3.

A first inflow opening 28 in the shape of a cutout is provided on an upper part of the third rise wall 26 and a similar second inflow opening 29 is provided on a downstream (i.e. downstream in a flow direction of the cooling air) side of the first inflow opening 28. A rib 51 serving as a guide extending between an inner surface of the clutch housing 23 and the third rise wall 26 is provided immediately at a downstream of the first inflow opening 28 so as to partition the second air-flow space 27. The muffler plate 71 serving as a guide is located immediately at a downstream of the second inflow opening 29 so as to close the most downstream part of the second air-flow space 27.

In contrast, an outflow opening 52 in the shape of a cutout is provided at an upstream (i.e. upstream in a flow direction of the cooling air) side of the first inflow opening 28 of the third rise wall 26. In other words, the cooling air flowing in the second air-flow space 27 collides with the rib 51 at an upper part of the second air-flow space 27 to be guided into the third air-flow space 53 surrounded by the third rise wall 26 from the first inflow opening 28 (see an arrow A3).

A part of the cooling air flowing in the second air-flow space 27 passing therethrough without entering through the first inflow opening 28 and a part of the cooling air flowing in the first air-flow space 45 collide with the muffler plate 71 to be guided into the third air-flow space 53 through the second inflow opening 29 (see an arrow A4).

Since the centrifugal clutch 20 is housed within the third air-flow space 53, the centrifugal clutch 20 is cooled by the cooling air flowing into the third air-flow space 53 (see arrows A3 to A6). Subsequently, the cooling air returns from the outflow opening 52 to the second air-flow space 27 to flow toward the engine 4 or to enter again into the third air-flow space 53 to cool the centrifugal clutch 20.

According to the exemplary embodiment as described above, since the cooling air flows in the third air-flow space 53, the centrifugal clutch 20 disposed within the third air-flow space 53 can be efficiently cooled by the cooling air. Thus, the deformation of the clutch housing 23 and consequent high temperature that causes dropoff of the bearing 24 can be avoided. Further, it is only necessary to provide the openings 28, 29 and 52 on the third rise wall 26 of the clutch housing 23, so that the structure can be simplified. Further, it is not necessary to provide a large number of slits for sucking the cooling air on the clutch housing 23, so that the rigidity can be ensured.

Figure 4:
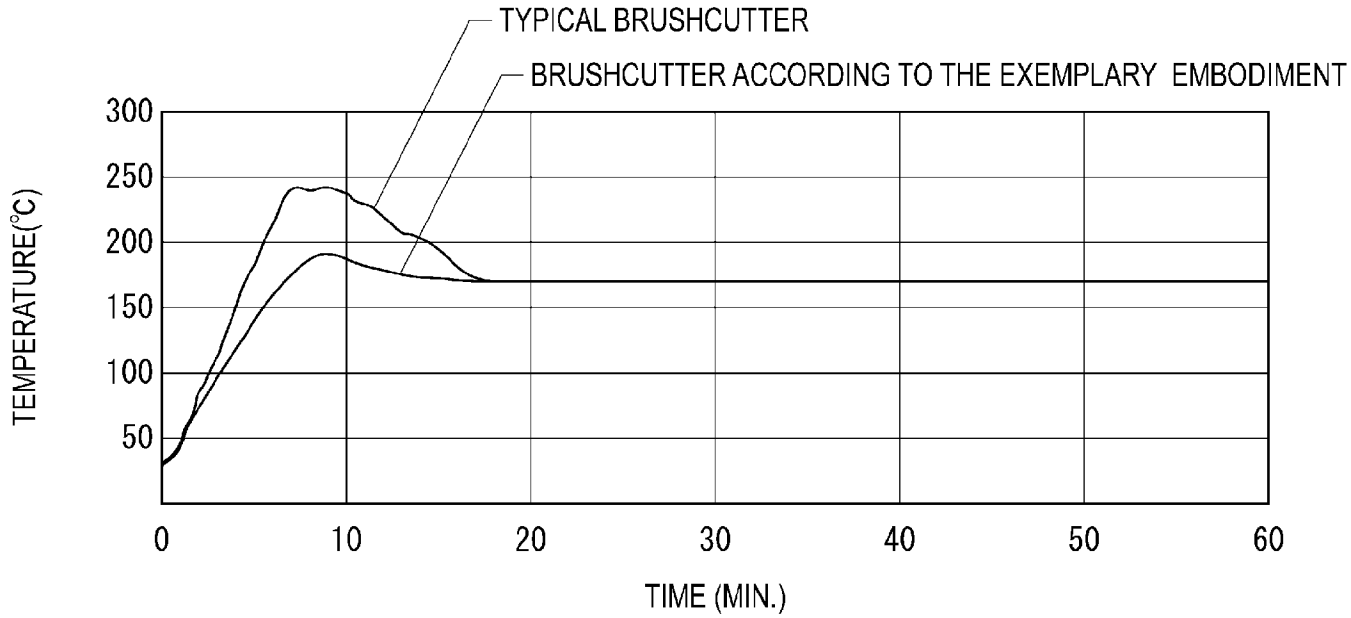
FIG. 4 is a graph showing an effect of the invention.

FIG. 4 shows experimental results using a typical brushcutter (chain line) having no third rise wall 26 and openings 28, 29 and 52 provided on the third rise wall 26 and the brushcutter 1 (solid line) according to this exemplary embodiment. These experiments were conducted by constantly slipping the clutch shoe relative to the clutch drum 21 of the centrifugal clutch 20 (as for the brushcutter 1 of this exemplary embodiment), and the temperature of the bearing 24 was measured in this state.

As a result of the experiments, it was observed that the temperature of the bearing 24 of the typical brushcutter was raised up to 240 degrees C. or more and the clutch housing 23 was deformed when the temperature reaches approximately 220 degrees C. On the other hand, the maximum temperature of the brushcutter 1 of this exemplary embodiment was approximately 187 degrees C. and no deformation of the clutch housing 23 was recognized.

Thus, the invention has been proved effective.

It should be understood that the scope of the invention is not limited to the above-described exemplary embodiment, but includes modifications as long as an object of the invention is achieved.

For instance, though it is described in the above exemplary embodiment that the clutch housing 23 having the third rise wall 26 and the openings 28, 29 and 52 is attached to the brushcutter 1 in advance, the clutch housing of this exemplary embodiment may be replaced with a clutch housing of a typical brushcutter. The brushcutter after replacement is within the scope of the invention.

Though both of the first inflow opening 28 and the second inflow opening 29 are provided on the third rise wall 26 in the above exemplary embodiment, it is only necessary that at least one of the openings is provided on the third rise wall 26. The number of the openings and the opening area of each of the openings may be determined as desired in implementing the invention considering the displacement of the engine 4 and the like.

Though each of the first inflow opening 28 and the second inflow opening 29 is provided in the shape of a cutout in the above exemplary embodiment, the first inflow opening 28 and the second inflow opening 29 may be provided in an encircled configuration such as a quadrangle and a circle. In other words, the configuration of the openings may be determined as desired.

INDUSTRIAL APPLICABILITY

The invention is applicable to any brushcutter irrespective of carrying types thereof such as shoulder-type and back-carrier type.

LIST OF ELEMENTS

1 . . . brushcutter
4 . . . engine
10 . . . cooling fan
20 . . . centrifugal clutch
23 . . . clutch housing
24 . . . bearing
26 . . . third rise wall (rise wall)
27 . . . second air-flow space (volute-shaped air-flow space)
28 . . . first inflow opening (inflow opening)
29 . . . second inflow opening (inflow opening)
31 . . . drive shaft
51 . . . rib (guide)
52 . . . outflow opening
71 . . . muffler plate (guide)

The invention claimed is:

1. A brushcutter comprising: an engine;

a cooling fan attached to a crankshaft of the engine;

a drive shaft that has a distal end attached with an attachment;

a centrifugal clutch that transmits a drive force of the engine from the crankshaft to a base end of the drive shaft;

a clutch housing that covers the cooling fan and the centrifugal clutch, the clutch housing being made of a synthetic resin;

wherein the clutch housing comprises cylindrical rise wall that rises towards the cooling fan and surrounding the centrifugal clutch, provided inside the clutch housing adjacent to an outer circumference of the centrifugal clutch and defining an air-flow space surrounding the clutch; and, at least one inflow opening on the rise wall that enables a cooling air flowing in the air-flow space, wherein a guide that partitions the air-flow space, to guide the cooling air into the inflow opening, is provided immediately at a downstream side of the inflow opening, and wherein the guide is provided by a part of a muffler plate disposed between an exhaust muffler attached to the engine and a cylinder of the engine.

2. The brushcutter according to claim 1, wherein the guide is provided by a rib extending between an inner surface of the clutch housing and the rise wall.

3. The brushcutter according to claim 1, wherein the outflow opening is provided at an upstream side of the inflow opening.

* * * * *